US006728388B1

(12) United States Patent
Nageno et al.

(10) Patent No.: US 6,728,388 B1
(45) Date of Patent: Apr. 27, 2004

(54) HEADPHONE

(75) Inventors: Koji Nageno, Tokyo (JP); Tomohiro Ito, Kanagawa (JP)

(73) Assignee: Sony Corporation, Tokyo (JP)

( * ) Notice: Subject to any disclaimer, the term of this patent is extended or adjusted under 35 U.S.C. 154(b) by 41 days.

(21) Appl. No.: 09/686,246

(22) Filed: Oct. 11, 2000

(30) Foreign Application Priority Data

Oct. 12, 1999 (JP) ..... P11-289883

(51) Int. Cl.[7] ..... H04R 25/00
(52) U.S. Cl. ..... 381/381; 381/330
(58) Field of Search ..... 381/330, 381, 381/379, 382; 180/328, 380, 130, 135

(56) References Cited

U.S. PATENT DOCUMENTS 2,474,135 A * 6/1949 White ..... 381/330
2,910,679 A * 10/1959 Baldwin ..... 340/575
3,457,565 A * 7/1969 Simpson et al. ..... 2/209
4,027,113 A * 5/1977 Matsumoto et al. ..... 381/378
4,588,868 A * 5/1986 Bertagna et al. ..... 381/382
5,533,137 A * 7/1996 Holmes ..... 381/370
5,757,944 A * 5/1998 Jensen et al. ..... 381/385
5,960,094 A * 9/1999 Jensen et al. ..... 381/381
6,418,230 B1 * 7/2002 McDonald et al. ..... 381/381
6,449,374 B1 * 9/2002 Skulley et al. ..... 381/381
2003/0002704 A1 * 1/2003 Pronk ..... 381/374
2003/0002706 A1 * 1/2003 Keliiliki ..... 381/381

* cited by examiner

*Primary Examiner*—Curtis Kuntz
*Assistant Examiner*—P. Dabney
(74) *Attorney, Agent, or Firm*—Jay H. Maioli

(57) ABSTRACT

An ear-hanging type headphone has an ear hanger arm attached to a rotation shaft portion that is movably mounted on a convex housing of a headphone body at a location that is offset from a central axis of the convex housing by a predetermined eccentric angle. Upon moving the rotation shaft portion relative to the convex housing a distance between the ear hanger arm and a sound emitting side of the headphone is altered to facilitate placing the headphone on the ear. The rotation shaft portion can be spring biased toward one end position and a retaining element can be used to temporarily retain the rotation shaft portion at another end position.

2 Claims, 12 Drawing Sheets

HEADPHONE

BACKGROUND OF THE INVENTION

1. Field of the Invention

The present invention relates to an ear-hanging type headphone which does not require a headband, and more specifically, relates to a headphone wherein the ear hanger arm is rotatably constructed via a rotary shaft portion eccentric with respect to the central axis of the headphone body portion, to thereby improve the wearing property of the headphone.

2. Background of the Invention

Recently, with advancement of the times of individuation centering on the youth, demands for a product whose design is regarded as important are increasing even in the headphone industry. In a-case of an ear-hanging type headphone, there is a strong demand for one having fashionability for the outdoor use, not having an image regarding function as important, such as conventional ones used in indoors for guidance in museums or the like, or used in international conferences or the like. However, in the outdoor use, it is also important, in view of safety, that the headphone can be quickly removed and mounted, for example, when the user changes a train or the like.

Here, one example of a conventional ear-hanging type headphone is shown in FIG. 14. A speaker unit (not shown) is built in a headphone housing 30, and one side of the headphone housing 30 is a sound production section side to which an ear cushion 31 is attached. An ear hanger arm 32 is connected by a fixed part 33 to the back side of the headphone housing 30, bent to a shape wrapped around the ear, and arranged on the front side of the ear cushion 31. The ear hanger arm 32 is made of a plastic molding material, and made detachable with respect to the ear cushion 31, utilizing an elastic deformation force thereof. Reference symbol 34 denotes a code pulled out from the headphone housing 30.

The above-described ear-hanging type headphone is mounted as shown in FIG. 15, in such a manner that the ear hanger arm 32 is hang on the ear with the ear hanger arm 32 being bent in a direction away from the ear cushion 31, to thereby support the dead weight of the headphone by the ear hanger arm 32, and the ear portion "e" is pressed on both sides of the ear hanger arm 32 and the ear cushion 31.

FIG. 16 to FIG. 18 show another example of the conventional ear-hanging type headphone. This headphone is constructed such that the ear hanger arm 36 is rotatable about a supporting point 37 with respect to the headphone housing 35, and located on the front side of the ear cushion 38, and the ear hanger arm 36 is spring-energized toward the ear cushion 38 side by means of a spring member (not shown) provided in the supporting point 37.

FIG. 19 to FIG. 21 also show an example in which the fitting angle of the supporting point 37 of the ear hanger arm 36 with respect to the headphone housing 35 is different from that of the headphone shown in the above-described FIG. 16 to FIG. 18.

FIG. 22 also shows another example of the conventional ear-hanging type headphone. This headphone is constructed such that an annular ear-hanging section 39 in a longitudinally elliptic shape along the shape of the ear portion and a ring-shaped holding section 40 in which the headphone housing is held are integrally formed by a plastic molding material, and a headphone housing 41 having a built-in speaker unit is held in the holding section 40 with the sound production section being inside. The holding section 40 is protruded stepwise towards this side with respect to the annular ear-hanging section 39, so that a gap "g" is produced vertically between the annular ear-hanging section 39 and the holding section 40.

The ear-hanging type headphone constructed as described above is mounted in such a manner that the annular ear-hanging section 39 is supported by the ear portion by inserting the ear portion into the gap "g" in the direction of an arrow, to give the insertion fitted condition of the headphone.

The insertion fitting operation of the headphone shown in FIG. 14 has a problem in that insertion fitting of the headphone is troublesome, since it is insertion fitted such that the headphone housing 30 is held by one hand, and while widening the ear hanger arm 32 by the other hand so as to alienate it from the headphone housing 30, the ear portion is inserted into the gap produced between them so as to be pressed on both sides. Moreover, the gap after completion of the headphone insertion fitting is required to be set narrow so as to give an initial load, taking into consideration the flexion of the ear hanger arm 32 due to the dead weight of the headphone. With such a structure, the gap is narrow on the side of the fixed part 33 of the ear hanger arm 32, and the gap becomes large on the tip end side, and hence, the ear portion inserted on the fixed part 33 side is pressed and becomes sore. As a result, there is a problem in long time use.

The headphone shown in FIG. 16 can uniformly hold the ear portion only in a part where the ear hanger arm 36 is parallel to the headphone housing 35, and as with the case of the headphone shown in FIG. 14, the gap is narrow on the supporting point 37 side of the ear hanger arm 36, and the gap becomes large on the tip end side. Therefore, for example, when a headphone having a standard size L in the distance from the supporting point 37 to the bending portion of the ear hanger arm 36, as shown in FIG. 17, is mounted on a large ear, the ear portion inserted on the supporting point 37 side is pressed and pain easily occurs. Moreover, when a headphone having a size $L_1$ for large ears in the distance from the supporting point 37 to the bending portion of the ear hanger arm 36, as shown in FIG. 18, is mounted on a small ear, a gap is formed between the headphone housing 35 and the supporting point 37. As a result, there is a problem in that the headphone housing 35 does not come into intimate contact with the ear portion, causing sound leakage and decrease in the tone quality.

Even in a case of the headphone shown in FIG. 19, the gap is narrow on the supporting point 37 side of the ear hanger arm 36, and the gap becomes widely open on the tip end side, as shown in FIG. 20, when a headphone having a standard size L in the distance from the supporting point 37 to the bending portion of the ear hanger arm 36 is mounted on a large ear, as with the case of FIG. 16, the ear portion inserted on the supporting point 37 side is pressed and pain easily occurs. Moreover, when a headphone having a size $L_1$ for large ears in the distance from the supporting point 37 to the bending portion of the ear hanger arm 36, as shown in FIG. 21, is mounted on a small ear, a wide gap is formed between the headphone housing 35 and the supporting point 37. As a result, there is a problem in that the headphone housing 35 does not come into intimate contact with the ear portion, causing sound leakage and decrease in the tone quality.

On the other hand, with the headphone shown in FIG. 22, the gap "g" between the annular ear-hanging section 39 and the holding section 40 is a gap which the ear portion can go through. Therefore, in the state that the headphone is inserted and fitted, there are such problems that the headphone housing 41 does not come into intimate contact with the ear portion, causing sound leakage and decrease in the tone quality, or insertion fitting becomes unstable, and headphone is easily dropped.

The present invention is for solving the above-described problems, and it is an object of the present invention to obtain an ear-hanging type headphone wherein insertion fitting operation of the headphone is quite easy, and insertion-fitting followingness of the headphone to the ear portion is increased without having any problem in long time use.

SUMMARY OF THE INVENTION

In order to achieve the above-described object, the headphone according to the present invention is constructed such that a rotation shaft portion is rotatably provided in a position eccentric within 45 degrees with respect to the center of the headphone body portion on the back side of the housing section, and an ear hanger arm portion is fitted to the rotation shaft portion.

According to the headphone constructed in this manner, the ear hanger arm portion can perform an operation alienating from the headphone body portion helically and in parallel therewith, by rotating the ear hanger arm portion about the rotation shaft portion. Therefore, in a state with the ear hanger arm portion being turned, the ear hanger arm portion is hang on the ear portion, and thereafter inversely rotated, to thereby uniformly press the ear portion on both sides of the ear hanger arm portion and the headphone body portion, with a movement of the ear hanger arm portion approaching the headphone body portion side in parallel therewith, and at the same time, the headphone body portion comes into intimate contact with the ear portion, to give a retention state of the headphone. When the headphone is removed, the ear hanger arm is turned in the direction to be alienated from the headphone body portion in parallel. Thereafter, the ear hanger arm can be removed by pulling up from the ear portion.

DETAILED DESCRIPTION OF THE PREFERRED EMBODIMENTS

Embodiments of an ear-hanging type headphone according to the present invention will now be described with reference to the drawings.

Figure 1:
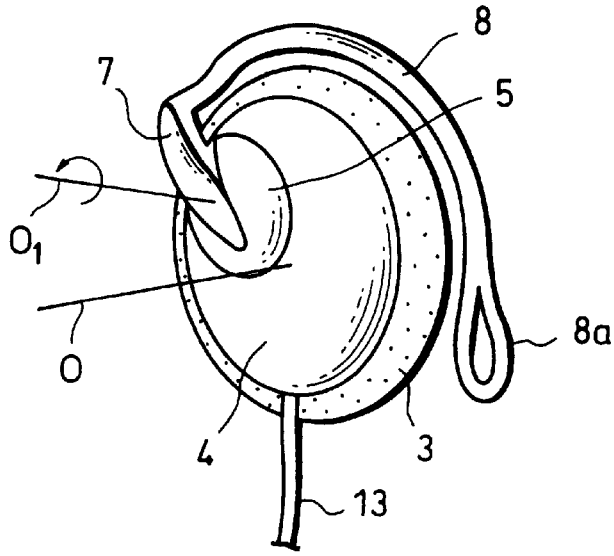
FIG. 1 is a perspective view showing the appearance of a headphone according to the present invention before mounting.
Figure 2:
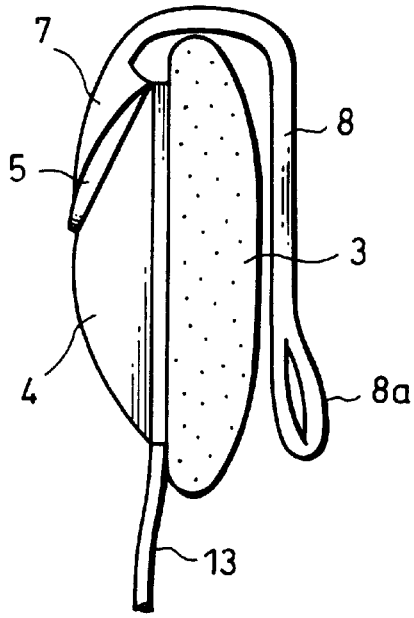
FIG. 2 is a side view of the headphone in FIG. 1, seen from the rear side.
Figure 3:
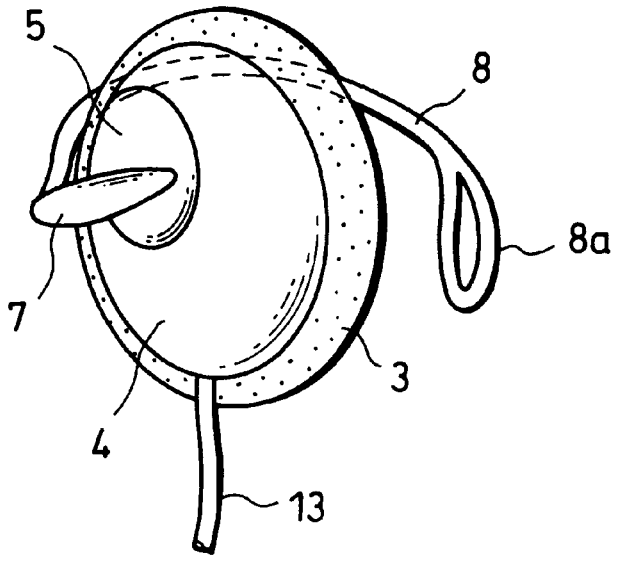
FIG. 3 is a perspective view showing the appearance of a headphone with an ear hanger arm being turned to a mounting position.
Figure 4:
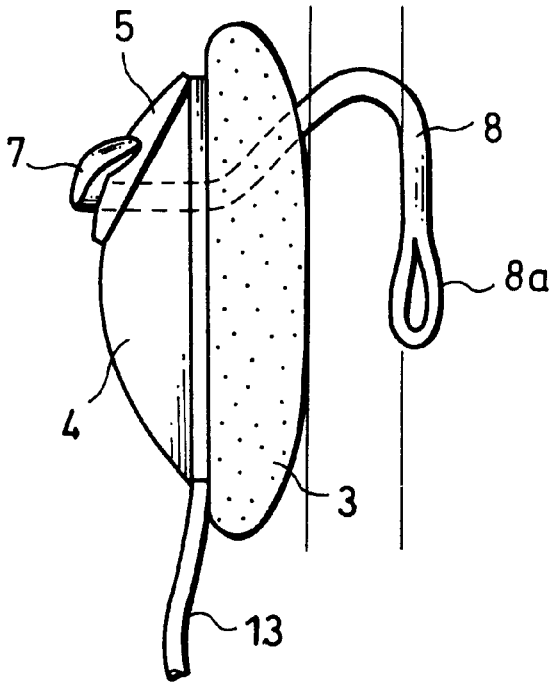
FIG. 4 is a side view of the headphone in FIG. 3, seen from the rear side.
Figure 5:
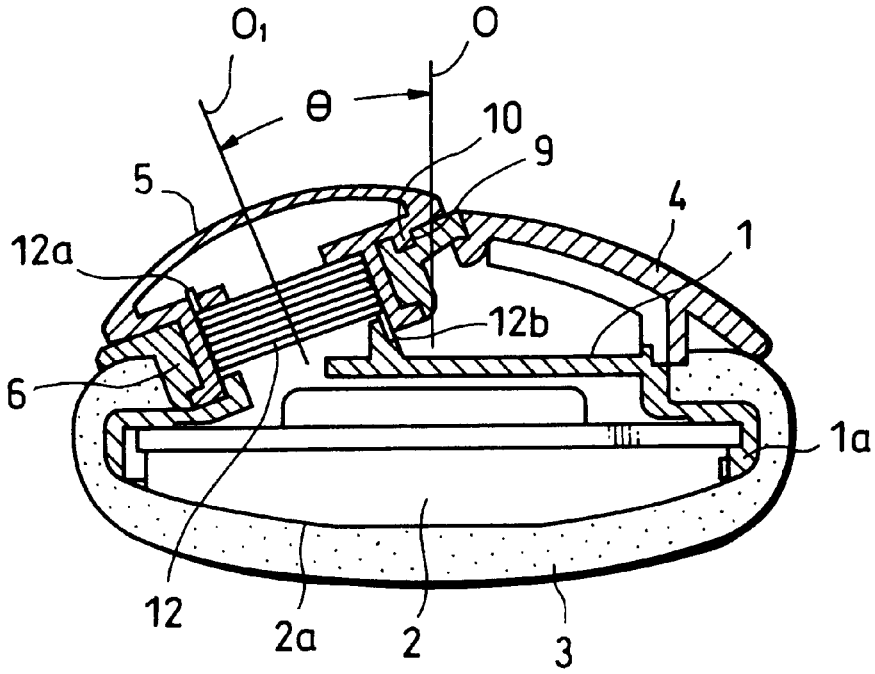
FIG. 5 is an enlarged sectional view of a headphone.

FIG. 1 is a perspective view of a headphone before insertion fitting, FIG. 2 is a side view thereof, FIG. 3 is a perspective view of the headphone when it is insertion fitted to the ear portion by rotating the ear hanger arm portion, FIG. 4 is a side view thereof, and FIG. 5 is an enlarged sectional view of the headphone.

A speaker unit 2 is built in a headphone body portion 1 with a state being held by a fitting portion la, and a sound production section 2a of the speaker unit 2 is covered with a sponge-like ear cushion 3.

The back side of the headphone body portion 1 is covered with a housing 4 having a convex surface, and a disc-like rotation shaft portion 5 is provided in the housing 4. The rotation shaft portion 5 is rotatably supported in the counterclockwise direction by a shaft supporting member 6 which is supported by the housing 4, designating, as a center of rotation, $O_1$ eccentric by θ with respect to the normal O at the center of the headphone body portion 1. The eccentric angle θ of the rotation shaft portion 5 is set within 45 degrees.

Then, an ear hanger arm 8 consisting of a plastic molded article is attached to the above-described rotation shaft portion 5 via a support 7. The ear hanger arm 8 has a shape extending from the housing 4 side toward the front face of the ear cushion 3 on the sound production section 2*a* side, and mounted to the ear portion (auricle). Also, the tip end portion of the ear hanger arm 8 is formed in a rounded protected end portion 8*a*.

In this manner, the ear hanger arm 8 is rotatable in the counterclockwise direction, seen from the housing 4 side, designating $O_1$ as a center of rotation, together with the rotation shaft portion 5, and the rotation range is regulated. This will be described with reference to FIG. 6.

On the shaft supporting member 6 is formed a guide groove 9 in a range within a predetermined angle, and a guide protrusion 10 protruding from the rotation shaft portion 5 is engaged with the guide groove 9. Accordingly, the rotation shaft portion 5 can be turned in a range that the guide protrusion 10 is movable within the guide groove 9.

Figure 6:
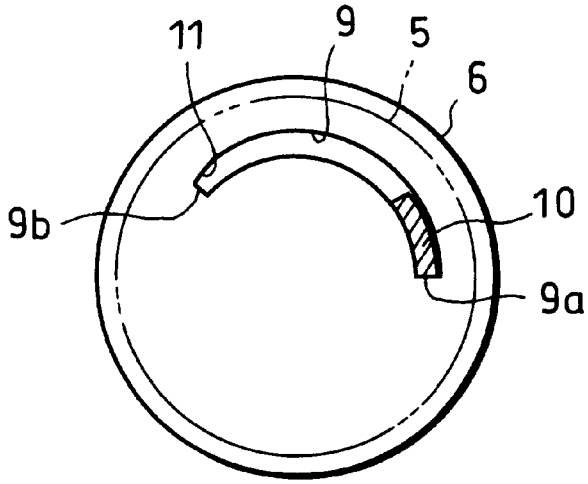
FIG. 6 shows a turn range regulation means and a rotation position lock means of a rotation shaft portion.

When the ear hanger arm 8 is in a position before the rotation, that is, substantially in contact with the front side of the ear cushion 3 as shown in FIG. 1 and FIG. 2, the guide protrusion 10 of the rotation shaft portion 5 is in a position on one end portion 9*a* of the guide groove 9, as shown in FIG. 6. When the ear hanger arm 8 is turned, as shown in FIG. 3 and FIG. 4, the ear hanger arm 8 is alienated from the front side of the ear cushion 3, to a position where the ear hanger arm 8 can be mounted on the ear portion, and the guide protrusion 10 of the rotation shaft portion 5 abuts against the other end portion 9*b* of the guide groove 9, and regulated. At this time, there is provided a rotation position lock means in which the guide protrusion 10 is press-fitted to and engaged with a narrow portion 11 formed on the end portion of the guide groove 9, to thereby lock the guide protrusion 10 temporarily.

Figure 7:
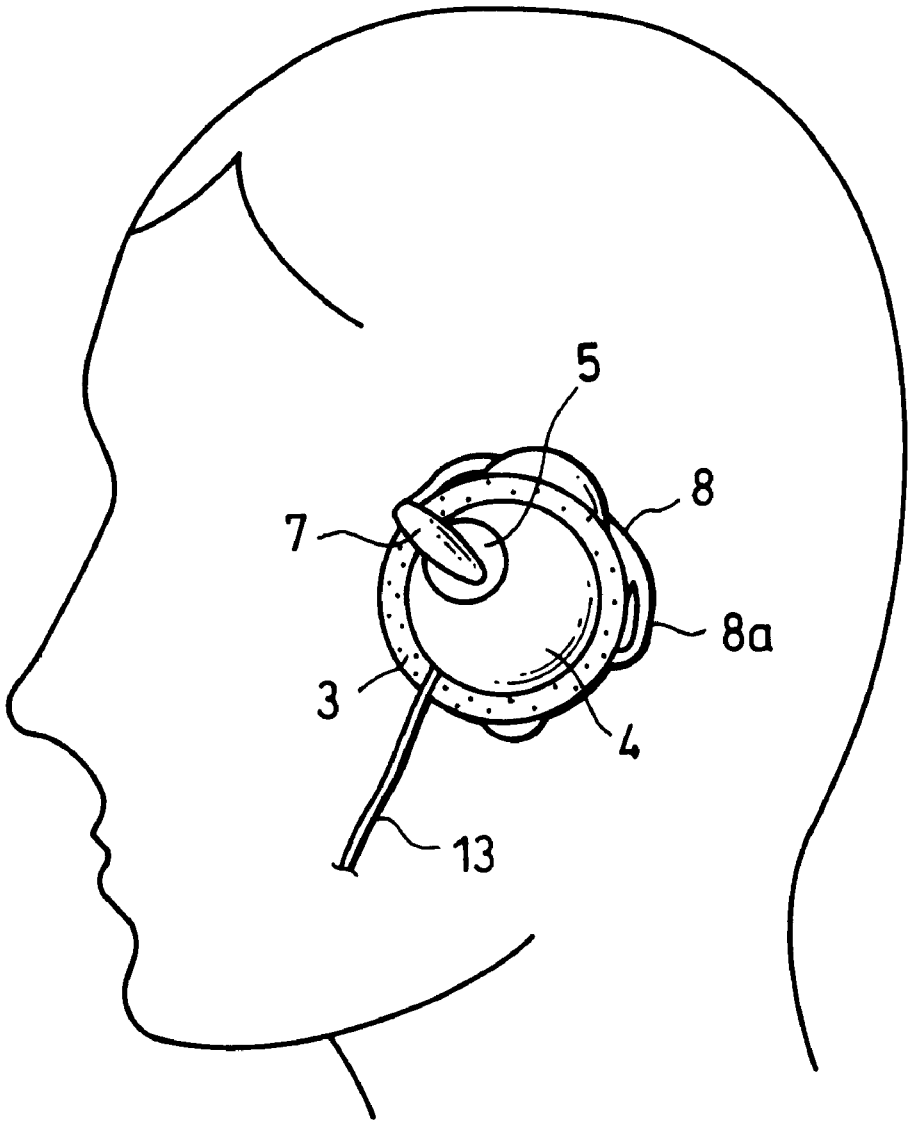
FIG. 7 is a diagram for explaining an ideal position of a rotation shaft portion with respect to a housing.

Here, it is important that the ear hanger arm 8 is alienated from the front side of the ear cushion 3 helically and in parallel therewith, when being turned to the position mountable to the ear portion together with the rotation shaft portion 5, and is moved helically and in parallel therewith close to the front side of the ear cushion 3, when turned inversely together with the rotation shaft portion 5. This is made possible by the fact that even if the ear hanger arm 8 is turned, the inclination of the ear hanger arm 8 and the plane attached to the housing 4 does not change, since the rotation shaft portion 5 is set to be rotatable centering on $O_1$ eccentric within 45 degrees with respect to the normal O at the center of the housing 4, and that the rotation shaft portion 5 is located at the front upper portion of the housing 4 in the mounting position of the headphone, as shown in FIG. 7. For example, if the rotation shaft portion 5 is provided at an eccentric angle of larger than 45 degrees with respect to the normal O at the center of the housing 4, when the ear hanger arm 8 is turned, the ear hanger arm 8 is not alienated from the ear cushion 3 helically and in parallel therewith, and the entire ear portion cannot be pressed at a uniform holding pressure between the ear cushion 3 and the ear hanger arm 8, and thereby causing pain due to oppression of the ear portion by means of the ear hanger arm 8, sound leakage, and decrease in the tone quality.

On the other hand, the rotation shaft portion 5 is provided with a torsion spring 12 consisting of a coil spring. The torsion spring 12 is arranged in a barrel portion of the rotation shaft portion 5, and one end portion 12*a* of the torsion spring 12 is supported on the rotation shaft portion 5 side, and the other end portion 12*b* is supported on the headphone body portion 1 side.

Accordingly, when the ear hanger arm 8 is turned to a position shown in FIG. 3 and FIG. 4 together with the rotation. shaft portion 5, the torsion spring 12 is wound up, thereby the above-described guide protrusion 10 is press-fitted to and engaged with the narrow portion 11 of the guide groove 9, being the rotation position lock means and temporarily locked, in a state with the spring force being generated. Hence, the ear hanger arm 8 is slightly pushed back in the return direction, to thereby release the lock of the guide protrusion 10 from the narrow portion 11, so that the ear hanger arm 8 is reversed together with the rotation shaft portion 5 due to the return force of the torsion spring 12, and returns to the position shown in FIG. 1 and FIG. 2. Here, reference symbol 13 denotes a code pulled out from the housing 4.

The mounting operation of the headphone constructed as described above is performed in the following manner.

At first, the ear hanger arm 8 is turned from the state shown in FIG. 1 and FIG. 2 to the turn-regulated position. Thereby, as shown in FIG. 3 and FIG. 4, the ear hanger arm 8 is temporarily locked by the rotation position lock means with the ear hanger arm 8 being alienated from the ear cushion 3 helically and in parallel therewith. If the lock of the ear hanger arm 8 is released, with the ear hanger arm 8 being hung on the ear portion in this state, the ear hanger arm 8 returns due to the spring force of the torsion spring 12, thereby the entire ear portion is uniformly pressed on both sides of the ear hanger arm 8 and the ear cushion 3 with an adequate retention force, while the ear cushion comes into intimate contact with the ear portion to give the headphone mounting state.

That is to say, according to the above-described headphone of the present invention, it can be reliably fitted to the ear portion of various sizes without discomfort and sound leakage, thereby enabling improvement in the tone quality, without any pain even in long time use.

With regard to the removal operation of the headphone, the ear hanger arm 8 is alienated from the ear cushion 3 by turning the ear hanger arm 8 again to the turn-regulated position, to release the pressing on the ear portion, and thereafter, the ear hanger arm 8 can be easily removed by pulling up from the ear portion.

Figure 8:
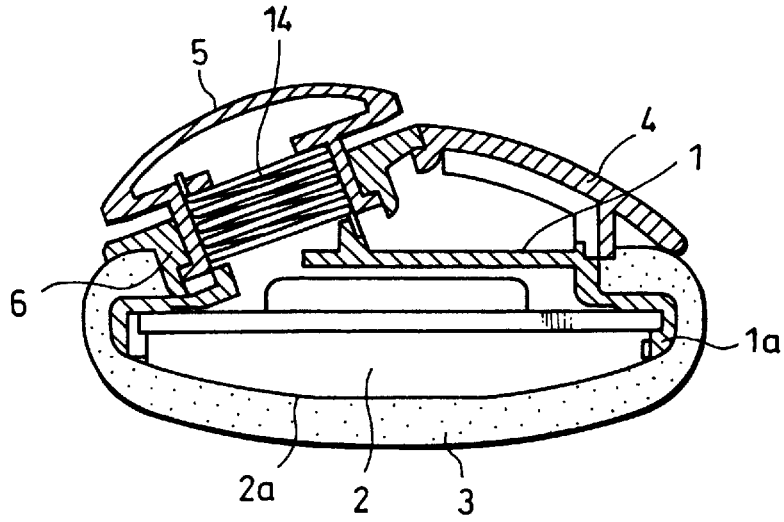
FIG. 8 is an enlarged sectional view of a headphone, showing another example of a rotation position lock means of a rotation shaft portion.
Figure 9:
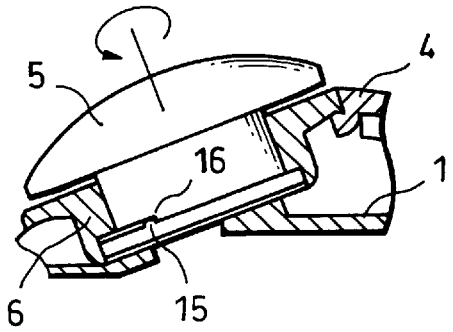
FIG. 9 is a diagram showing a locked condition of a rotation shaft portion by means of the rotation position lock means in FIG. 8.
Figure 10:
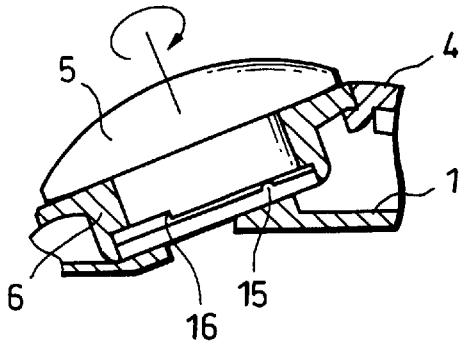
FIG. 10 is a diagram showing a lock-released condition of the rotation shaft portion.

FIG. 8 to FIG. 10 show another example of the rotation position lock means of the ear hanger arm 8. The same portions as the components shown in FIG. 5 are denoted by the same reference symbols.

According to another embodiment, spring action is imparted to the torsion spring 14 arranged in the barrel portion of the rotation shaft portion 5 in the elongation direction as well as the torsional direction, and the rotation shaft portion 5 is spring-energized by the torsion spring 14 to the position protruding with respect to the shaft supporting member 6. Moreover, a protrusion 15 is provided in the barrel portion of the rotation shaft portion 5, and an engagement stepped portion 16 is formed on the housing 4 side corresponding thereto.

The rotation position lock means is constructed such that when the ear hanger arm (not shown) winds up the torsion spring 14 to turn to the turn movement range, the protrusion 15 of the rotation shaft portion 5 is fitted to the engagement stepped portion 16 on the housing 4 side, as shown in FIG. 9, to thereby temporarily lock the ear hanger arm together with the rotation shaft portion 5. In order to release the lock of the ear hanger arm 8, the ear hanger arm is reversed while pressing the rotation shaft portion 5, to thereby alienate the protrusion 15 from the engagement stepped portion 16 to release the lock. Thereafter, the ear hanger arm turns to the original position due to the return spring force of the torsion spring 14, to perform an operation for mounting the headphone by pressing the ear portion on both sides of the ear hanger arm and the ear cushion.

Figure 11:
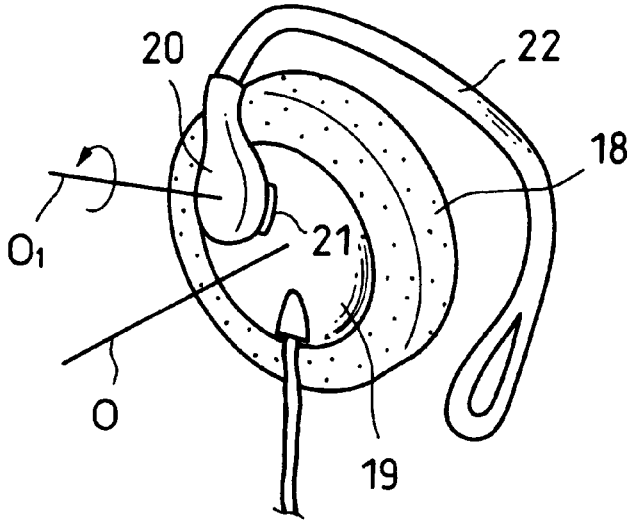
FIG. 11 is a perspective view showing the appearance of a headphone in another embodiment of the present invention.

Another embodiment of the headphone according to the present invention is shown in FIG. 11.

According to this embodiment, a support 20 is rotatably fitted to a housing 19 on the side opposite to an ear cushion

18 covering the sound production section of the headphone by means of a rocker fulcrum shaft 21, and an ear hanger arm 22 is fitted to the support 20 and arranged on the front side of the ear cushion 18. The center of rotation $O_1$ of this rocker fulcrum shaft 21 is located in a position eccentric by about 45 degrees with respect to the normal O at the center of the headphone. The ear hanger arm 22 in this case is also constructed such that when returning to the original position from the turned position, it returns by means of a spring member (not shown) arranged in the housing 19.

Figure 12:
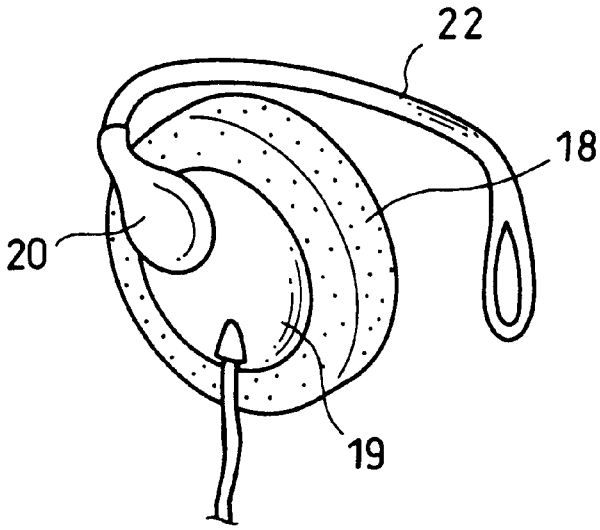
FIG. 12 is a perspective view showing the appearance of a headphone with an ear hanger arm being turned to a mounting position in the embodiment shown in FIG. 11.

The headphone constructed in this manner operates such that when the ear hanger arm 22 is turned, the ear hanger arm 22 can be alienated from the front side of the ear cushion 18 helically and in parallel therewith, as shown in FIG. 12, thereby the entire ear portion can be uniformly pressed on both sides of the ear hanger arm 22 and the ear cushion 18, as with the headphone shown in FIG. 1, and the ear cushion 18 comes into intimate contact with the ear portion, to give a headphone having no problem such as sound leakage and decrease in the tone quality.

Figure 13:
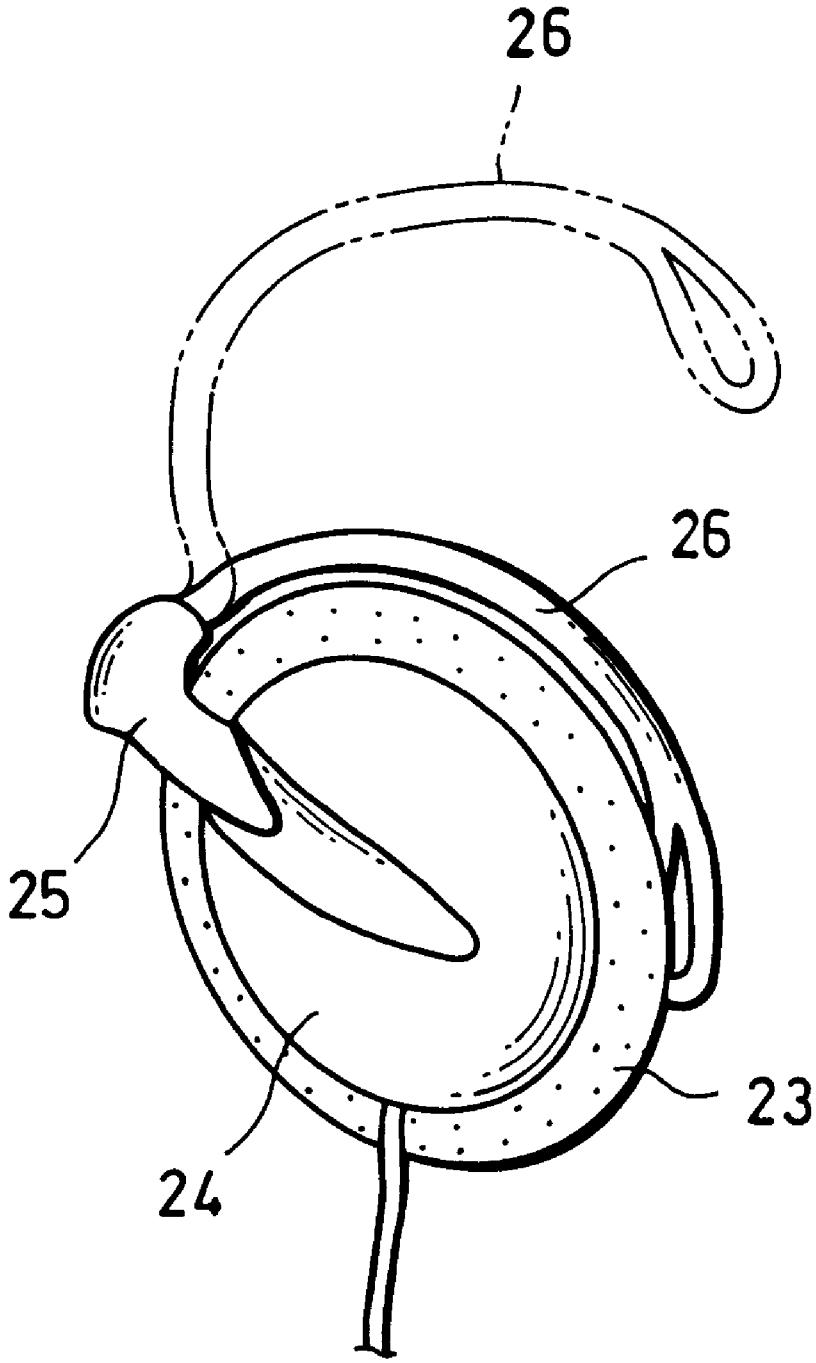
FIG. 13 is a perspective view showing the appearance of a headphone in another embodiment of the present invention.
Figure 14:
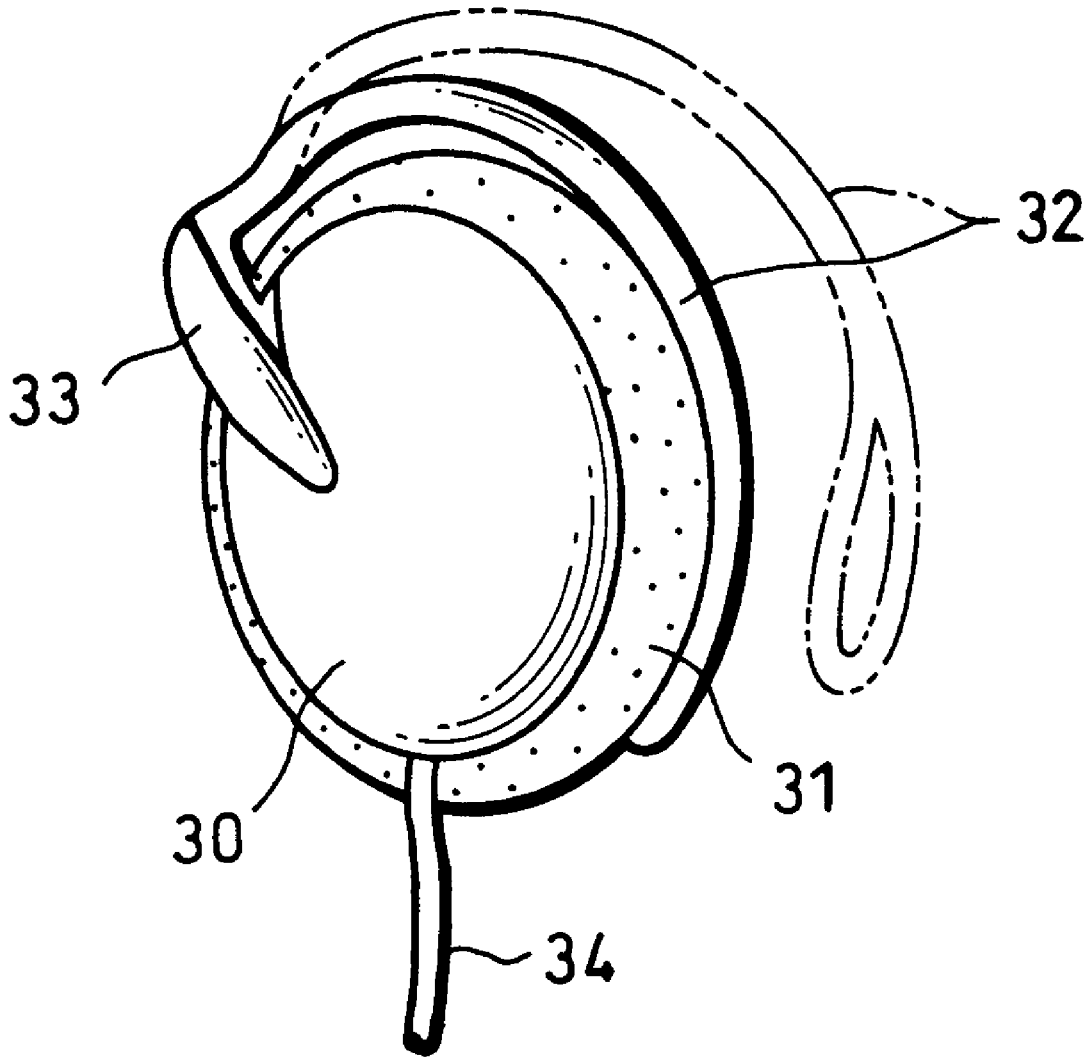
FIG. 14 is a perspective view showing the appearance of a conventional headphone.
Figure 15:
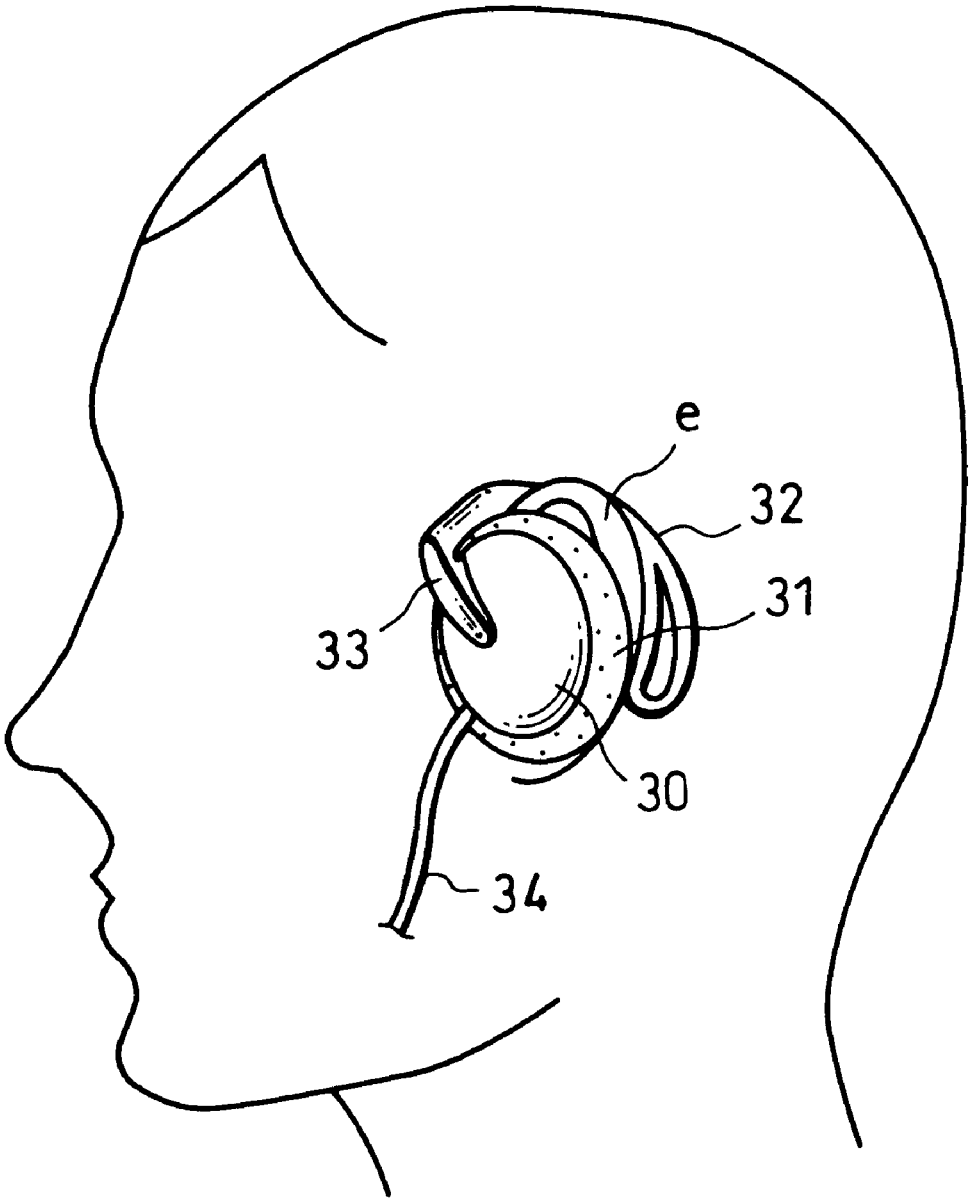
FIG. 15 is an elevational view of the conventional headphone shown in FIG. 14 in amounting condition.
Figure 16:
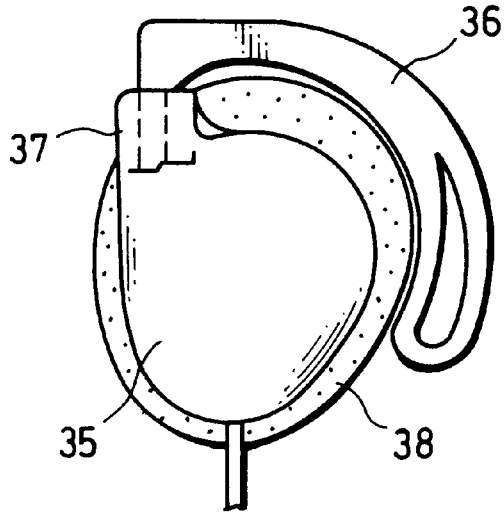
FIG. 16 is an elevational view of another conventional headphone.
Figure 17:
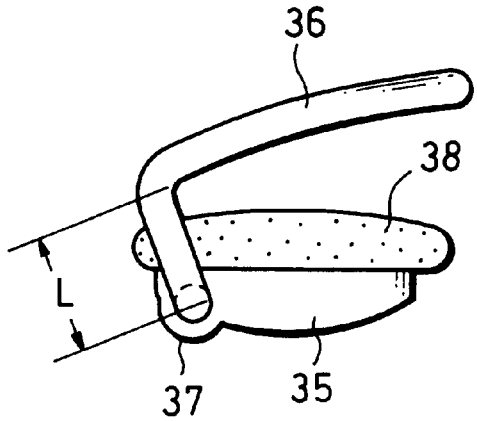
FIG. 17 is a plan view in the case where the headphone is mounted on a large ear.
Figure 18:
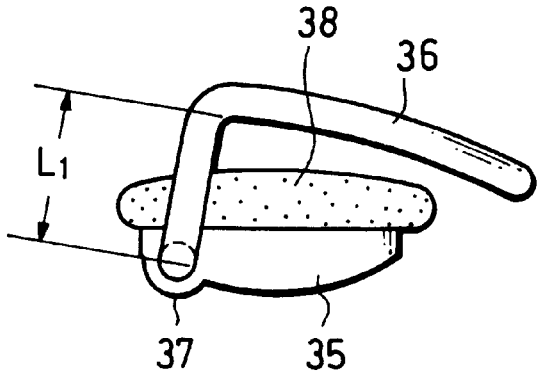
FIG. 18 is a plan view in the case where the headphone is mounted on a small ear.
Figure 19:
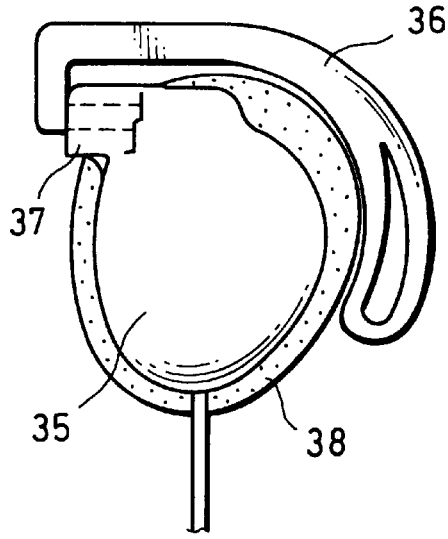
FIG. 19 is an elevational view of still another conventional headphone.
Figure 20:
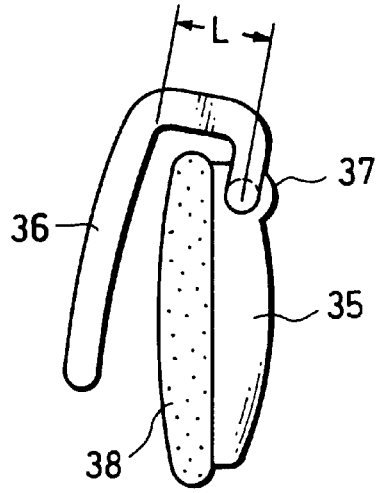
FIG. 20 is a side view in the case where the headphone is mounted on a large ear.
Figure 21:
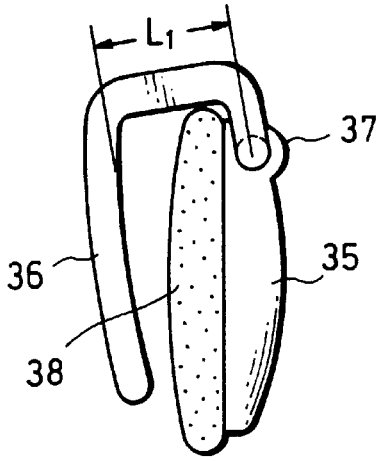
FIG. 21 is a side view in the case where the headphone is mounted on a small ear.
Figure 22:
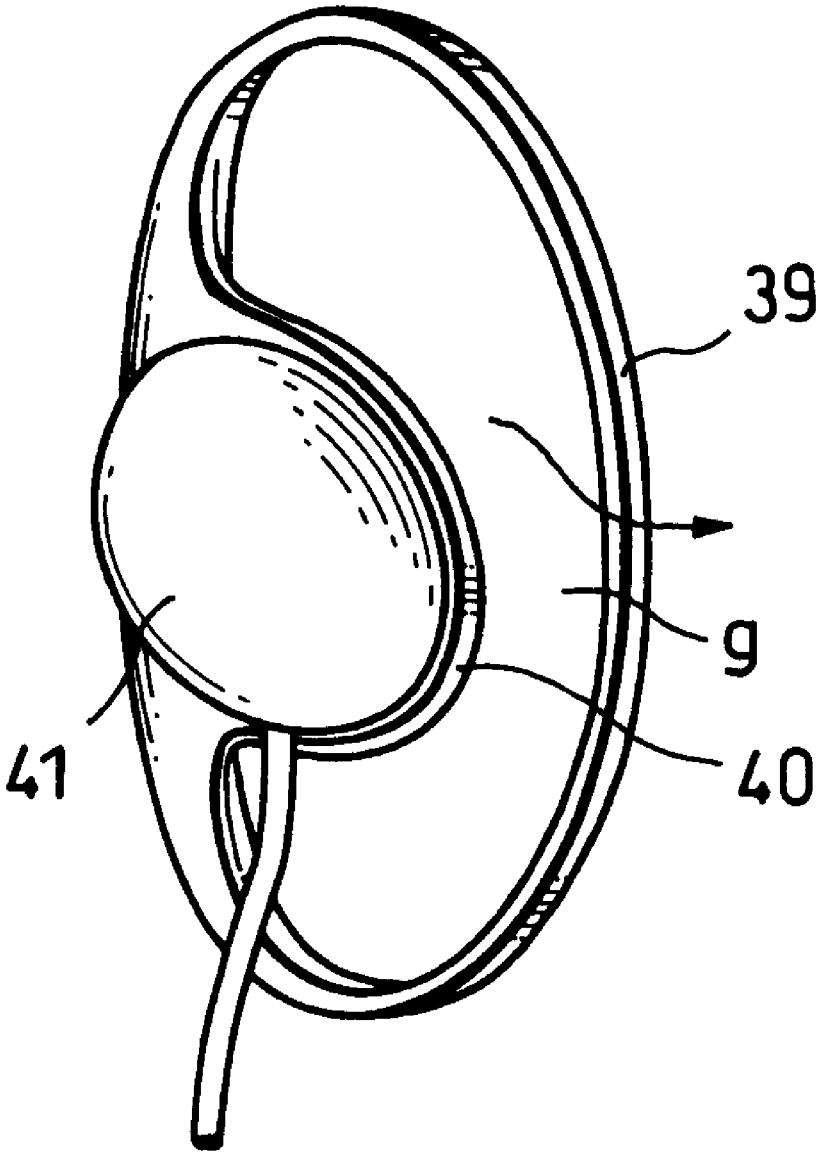
FIG. 22 is a perspective view showing the appearance of a different conventional headphone.

Still another embodiment of the headphone is shown in FIG. 13.

According to this embodiment, a support 25 is fitted to a housing 24 on the side opposite to the ear cushion 23 covering the sound production section of the headphone so as to face the front side of the ear cushion 23, and an ear hanger arm 26 is rotatably supported on the fixed part 25 and arranged on the front side of the ear cushion 23.

In the case of the above-described headphone, the ear hanger arm 26 is turned toward the outer peripheral side substantially in parallel with the front side of the ear cushion 23, as shown in a virtual line, and hence in a state that the headphone is mounted, the entire ear portion is uniformly pressed on both sides of the ear hanger arm 26 and the ear cushion 23, and the ear cushion 23 comes into intimate contact with the ear portion, to give a headphone having no problem such as sound leakage and decrease in the tone quality.

Having described preferred embodiments of the invention with reference to the accompanying drawings, it is to be understood that the invention is not limited to those precise embodiments and that various changes and modifications could be effected therein by one skilled in the art without departing from the spirit or scope of the invention as defined in the appended claims.

What is claimed is:

1. An ear-hanging type headphone comprising:

a headphone body portion having a speaker unit built therein and a sound production section of said speaker unit on a front side, with a back side being covered with a convex housing section;

a rotation shaft portion movably mounted on the housing section and having a central axis thereof offset from a central axis of the convex housing section by an eccentric angle of 45 degrees; and an ear hanger arm portion supported by the rotation shaft portion and located on the sound production section side, whereby upon moving the rotation shaft portion relative to the convex housing portion a distance between the ear hanger arm portion and the front side of the headphone body portion is altered, wherein a slot is formed in the convex housing section and the rotation shaft portion is movable from one end of the slot to another end of the slot and the rotation shaft portion includes a spring for biasing the rotation shaft portion toward the one end of the slot.

2. An ear-hanger type headphone comprising:

a headphone body portion having a speaker unit built therein and a sound production section of said speaker unit on a front side, with a back side being covered with a convex housing section;

a rotation shaft portion movably mounted on the housing section and having a central axis thereof offset from a central axis of the convex housing section by an eccentric angle of 45 degrees; and an ear hanger arm portion supported by the rotation shaft portion and located on the sound production section side, whereby upon moving the rotation shaft portion relative to the convex housing portion a distance between the ear hanger arm portion and the front side of the headphone body portion is altered, wherein the rotation shaft portion is rotatable relative to the convex housing section and the: rotation shaft portion comprises turn range regulation means and rotation position lock means for controlling the rotation of the rotation shaft portion.

* * * * *